US009151011B2

(12) United States Patent
Trevisani et al.

(10) Patent No.: US 9,151,011 B2
(45) Date of Patent: Oct. 6, 2015

(54) DRILLING DEVICE FOR EXECUTING DIAPHRAGM WALLS AND METHOD THEREOF

(75) Inventors: Davide Trevisani, Cesena (IT); Stefano Trevisani, Cesena (IT); Maurizio Siepi, Cesena (IT); Carlo Crippa, Cesena (IT)

(73) Assignee: SOILMEC S.P.A., Cesena (FC) (IT)

( * ) Notice: Subject to any disclaimer, the term of this patent is extended or adjusted under 35 U.S.C. 154(b) by 433 days.

(21) Appl. No.: 13/186,209

(22) Filed: Jul. 19, 2011

(65) Prior Publication Data

US 2012/0012391 A1 Jan. 19, 2012

(30) Foreign Application Priority Data

Jul. 19, 2010 (IT) ..... TO2010A0618

(51) Int. Cl.

| | |
|---|---|
| ***E02D 5/20*** | (2006.01) |
| ***E02F 3/08*** | (2006.01) |
| ***E02D 17/13*** | (2006.01) |
| ***E02D 19/18*** | (2006.01) |
| ***E02F 3/20*** | (2006.01) |

(52) U.S. Cl.

CPC ..... *E02D 17/13* (2013.01); *E02D 19/18* (2013.01); *E02F 3/205* (2013.01)

(58) Field of Classification Search

USPC ..... 175/57, 408; 405/262, 284, 285; 37/189, 91; 52/169.1, 741.13

See application file for complete search history.

(56) References Cited

U.S. PATENT DOCUMENTS

| | | | | | |
|---|---|---|---|---|---|
| 3,429,126 | A | * | 2/1969 | Wey | 405/267 |
| 3,513,572 | A | * | 5/1970 | Novet | 37/461 |
| 3,534,561 | A | * | 10/1970 | Kida | 405/238 |
| 3,645,101 | A | * | 2/1972 | Sherard | 405/267 |
| 3,839,871 | A | * | 10/1974 | Dyer et al. | 405/267 |
| 4,075,852 | A | * | 2/1978 | Tamaro | 405/267 |
| 4,465,403 | A | * | 8/1984 | Schreiber et al. | 405/267 |
| 4,601,615 | A | * | 7/1986 | Cavalli | 405/267 |
| 4,930,940 | A | * | 6/1990 | Charlier et al. | 405/267 |
| 5,022,792 | A | * | 6/1991 | Konno et al. | 405/267 |
| 5,056,242 | A | * | 10/1991 | Miotti | 37/94 |
| 5,263,798 | A | * | 11/1993 | Dupeuble et al. | 405/287 |

(Continued)

FOREIGN PATENT DOCUMENTS

| | | |
|---|---|---|
| DE | 1 484 545 | 5/1969 |
| DE | 1 634 323 | 7/1970 |

(Continued)

OTHER PUBLICATIONS

Italian Search Report for application No. IT TO20100618 dated Apr. 13, 2011.

*Primary Examiner* — Kenneth L Thompson

(74) *Attorney, Agent, or Firm* — Merchant & Gould P.C.

(57) ABSTRACT

A drilling method and device is for the execution of diaphragm walls by cutters, (131, 105, 110) carried by a frame (130) supported by suspension and movers (102). A guide hole (200) is formed as far as the depth specified in the design at the center of the panel to be made. Excavation is started with the introduction into the guide hole (200) of a guide element (101) that is fixed with respect to the tool-holder frame and having geometry such as to copy the guide hole along which it slides during excavation. Excavation is carried out as far as the depth specified in the design. The tool is extracted from the excavation and the excavation is filled with concrete and a panel is formed. The method is repeated so as to form adjacent panels.

19 Claims, 6 Drawing Sheets

(56) References Cited

U.S. PATENT DOCUMENTS

| | | | | |
|---|---|---|---|---|
| 5,813,151 | A | 9/1998 | Stephens et al. | |
| 7,559,161 | B2 * | 7/2009 | Stoetzer | 37/189 |
| 7,637,038 | B2 * | 12/2009 | Arzberger et al. | 37/91 |
| 8,608,410 | B2 * | 12/2013 | Shreider et al. | 405/267 |
| 2004/0208710 | A1 * | 10/2004 | Shreider et al. | 405/267 |
| 2012/0000148 | A1 * | 1/2012 | Borel et al. | 52/169.1 |

FOREIGN PATENT DOCUMENTS

| | | |
|---|---|---|
| DE | 38 23 784 | 1/1990 |
| DE | 10 2005 059 824 | 6/2007 |
| EP | 0 580 264 | 1/1994 |
| EP | 1 630 301 | 3/2006 |
| GR | 9330042 | 6/1993 |
| JP | 58-156630 | 9/1983 |
| JP | 59-130920 | 7/1984 |

* cited by examiner

DRILLING DEVICE FOR EXECUTING DIAPHRAGM WALLS AND METHOD THEREOF

This application claims benefit of Serial No. TO 2010 A 000618, filed 19 Jul. 2010 in Italy and which application is incorporated herein by reference. To the extent appropriate, a claim of priority is made to the above disclosed application.

BACKGROUND

In the field of deep foundations, and especially for repairing existing dams, there is the need of identifying a method and a device for forming impermeable diaphragm walls at great depths, in ground with high resistance, and that can ensure high accuracy and productivity.

In EP 0580.264 the guide pre-excavations are carried out with a pile machine. The miller is guided on two pre-excavations with tubular-shaped shields. The guide pre-excavations, however, must be very precise and in order to allow the milling body to have some clearance, one of the two guide shields is mounted on the articulated parallelogram with a spring system. In any case, if the shield moves far away a "dead area" is generated which is not excavated by the wheel.

Moreover, the hole is made by using a ballasted tool (35 tonnes plumb-lined with an upward pull of 10-15 tonnes), therefore if the pre-holes are not vertical, the tool guided by the holes would follow their profile and therefore it would not be possible to be certain that a perfect vertical hole would be made.

Moreover, since the guide shields are ballasted in their lower part and they extend beyond the excavation wheels, it is necessary to carry out the guide holes deeper with respect to the required depth.

Finally, the use of shape-tube during the casting of the panel so as to leave a guide hole free for the following panel poses practical construction problems which cannot always be solved.

This shape-tube has, on the side opposite the casting volume, an inflatable membrane so that the concrete hardens taking up the precise shape of the excavation guide. In the case in which there are very deep diaphragm walls, the use of a shape-tube can be impossible for practical reasons.

DE 1484545 describes a system for ensuring contiguous panels do intersecate. According to this patent, guide holes are formed at the joints between the panels through a pile machine. Subsequently, the bucket excavates between these, without necessarily having guide elements engaging in the holes, but simply exploiting the fact that the clam-shells remain in the area which has already been excavated since there is less resistance.

The aforementioned patent, however, does not describe a method or a device for solving the problem of the deviation of the guide piles.

In JP 59130920 two guide pre-holes are exploited at the joints of adjacent panels. The pre-holes are partially filled with low strength concrete; when casting these, tubes that remain hollow on the inside are introduced. The area which remains free constitutes the guides for two lateral shields mounted on the miller.

The tubes that are lowered inside the pre-holes, however, must be located in a very precise manner, and without external adjustment and fixing means (like mechanical or hydraulic tube centring means commonly called "plumb device") it is very difficult for them to stay in position, especially during the casting. If the tubes are not kept perfectly vertical and parallel to one another, the following tool can encounter difficulties when proceeding inside the hole.

Moreover, the shields mounted on the miller body have jacks which are surely used to recover clearances in the guide and presumably to carry out small deviation corrections.

FR 19910004847 describes a method and equipment for guiding a tool for diaphragm walls for avoiding that two adjacent panels diverge.

The guide is a component that is inserted for the entire depth which is intended to be excavated. Inside this a filler is cast (low strength concrete or foams) which stabilizes the guide, whereas an area (in one case the central part, in another case two lateral areas) remains free so as to receive a guide element that is attached to the miller body. Through the control of the wheels a force is generated in the direction of the guide so as to ensure that the miller body remains adherent to the guide itself.

However, generating the force in the direction of the guide implies using the two wheels on the opposite side with higher revs than the others; this means that the entire productivity of the machine is not used.

Moreover, the use of a single guide on one side does not actually prevent the tool from rotating about the longitudinal excavation direction and does not therefore ensure the perfect alignment of contiguous panels. Moreover the guide has such a rectangular geometry that it is necessary to make the first panel (which is not a circular hole in this case) with an excavation technology that is intrinsically less precise (bucket, miller) thus presumably using the same tool, but not guided.

DE 1634323 describes a device (of the tube form type) to be inserted in the panel excavated at the guide pre-hole before casting the panel so that the pre-hole remains free for the following panel. This device has two mobile shells which can be adapted to the walls of the excavation.

The patent, however, does not describe a method or a device for minimising the problem of deviation of the guide piles.

DE 3823784 describes a method and a tool for obtaining narrow waterproofing panels, by using a trencher (chain cutting) guided by two uprights inserted in two holes previously obtained. The patent also describes the fact that the cutting edge of the chain is at an angle with respect to the horizontal.

As a matter of fact having a very wide angle on the cutting edge implies an increase in the surface to be excavated and thus a reduction of the productivity for the same installed power. Moreover, it makes it necessary to reach a greater excavation depth with respect to the height specified in the design.

In addition, having a single cutting chain means that the loads generated during the drilling are not balanced and tend to deviate the tool, thus increasing the risks of getting stuck due to the use of two guides simultaneously.

JP 58156630 describes a method and a device for making long diaphragm walls in a single step.

The system is of the horizontal trencher type. Two guide holes are made at the ends of the panel. The structures that contain a thrust system for the trencher, made with a rope actuated from outside and some diverter pulleys, are housed inside these holes.

The holes, however, will have a limited depth since it is necessary for the thrusted guiding and pulling structure to reach the depth required for the panel. The invention proposes to increase the field of application of the devices for making diaphragm walls in rock or high resistance ground, and at the same time ensure verticality of the panels within certain limits and their alignment.

In order to increase the excavation capability it is necessary to increase the weight of the excavating device, but as known this increases the deviations. Consequently it is necessary to use a guide system for minimising and/or correcting the deviations.

The prior art describes methods which are not optimal. Indeed, in some cases like those mentioned above EP 0580264A1, DE 1484545A1, JP 59130920A, DE 1634323B1, DE 3823784A, JP 58156630A methods are described that exploit two holes as guides at the ends of the panel, but these methods require the two holes to be extremely precise and parallel to one another. Indeed, considering depths in the order of 100 m, even when exploiting the most precise technologies, it is not possible to drop below deviations of 20 cm. Considering that the two guide holes can deviate in different directions, and thus diverge or converge, there is the risk of the tool getting stuck, of breaking or of a great drop in production.

The system proposed by the aforementioned patent EP 0580264 foresees using an articulated parallelogram system which does not solve the problem since, if the deviation of the guide holes is very strong, a "dead area" is generated in which the tool does not excavate, thus generating cusps which can make the tool become stuck.

Not even the aforementioned patent FR 19910004847 solves the problem. Indeed, by using a single guide on one side of the panel, the system does not in fact prevent the tool from rotating about the longitudinal excavation direction and therefore it does not ensure the perfect placing of contiguous panels over one another and their alignment along a direction specified in the design. Furthermore, the excavation that receives the guide system has a rectangular geometry such that it is necessary to make the first panel with an excavation technology which is not very precise, presumably with the same tool but not guided, thus obtaining a first panel which is not very precise, even though it is the most important one since it is that which will carry the guide. Such a system thus ensures the continuity of the diaphragm wall formed by the different elements, but not the accuracy in terms of verticality. Moreover, the device described in the aforementioned patent JP 58156630 is not suitable for reaching great depths since it requires the positioning of the structure in order to carry out the thrust to a maximum required depth. The latter moreover must be blocked from outside in order to exert its thrust.

SUMMARY

The purpose of the present invention is to identify a method and to make a digging device for making continuous and aligned panels, even at great depths, in grounds with high resistance and that can ensure high productivity and precision.

In order to achieve these and further purposes which shall become clearer in the rest of the description, the invention proposes to make a drilling method for making diaphragm walls and a device for carrying out the aforementioned method.

BRIEF DESCRIPTION OF THE DRAWINGS

In the following figures a miller-type tool is represented, but it can usefully be applied also to other excavation systems, such as buckets.

Now we shall describe a method and a device with reference to the attached figures, in which.

DETAILED DESCRIPTION

Figure 1:
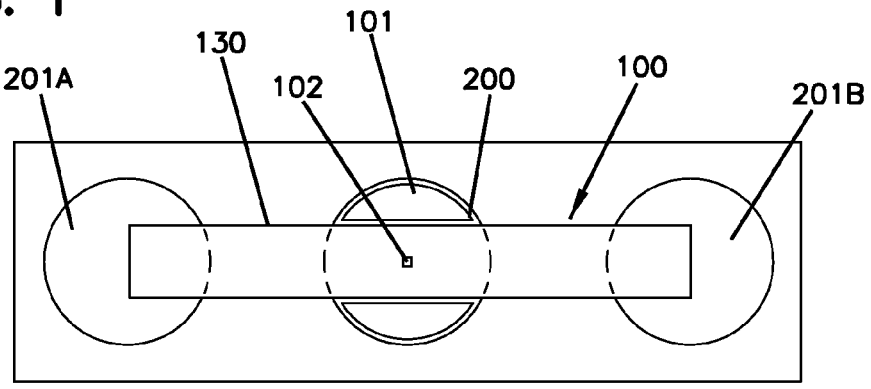
FIG. 1 represents a plan view of the excavation tool and a first guiding method.
Figure 2:
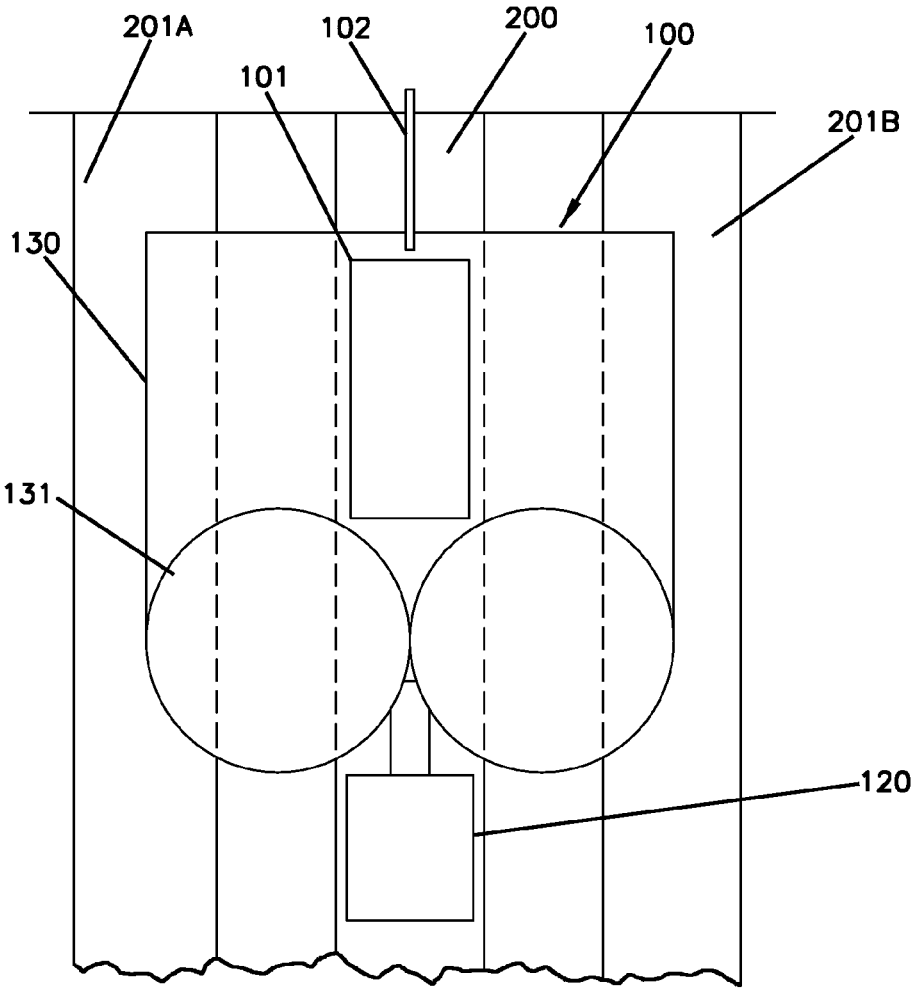
FIG. 2 shows a sectioned side view of the excavation tool with the same guiding method.

With reference now to FIGS. 1 and 2, the method foresees making guide hole 200 to the depth specified in the design, at the centre of the panel. If the design of the panel requires high precision it is possible to make this hole with technologies which make it possible to have good verticality, for example with the aid of vertically directed drilling techniques which foresee the execution of a hole with small dimensions in the direction of controlled excavation which is then subsequently enlarged by a standard drilling machine so as to obtain the desired diameter with greater dimensions. Subsequently holes 201A and 201B are made, to a depth specified in the design, at the joint between two panels. Only if required by the foundation design, these holes can also be carried out with technologies that make it possible to have good verticality. At this point it is possible to use tool 100. Hole 200 is exploited so as to be guided in a precise manner and so as to avoid deviations of the tool.

In a first version this can be made by a main frame 130 that carries an upper guide element 101 and, at the bottom it carries cutting means 131 (schematised here as drums) which carry out the excavation of the part of diaphragm wall outside central hole 200. The tool is moved in the hole through suspension and movement elements 102. Guide 101 can be made through shields positioned along the tool with a geometry such as to mate with the guide hole. Element 102 can be flexible through known rope or chain systems or it can be rigid like for example the known so called "Kelly" or jointed rods system which also makes it possible to direct tool 100 about the longitudinal excavation axis.

Figure 3:
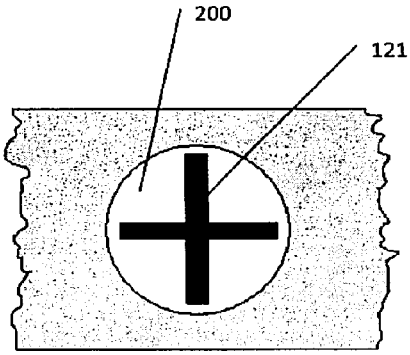
FIGS. 3 and 4 illustrate variants of the lower guide system.
Figure 4:
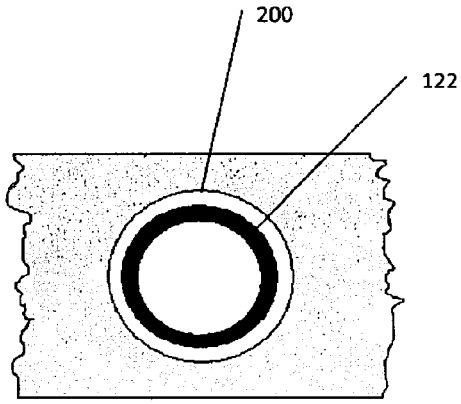
Figure 5:
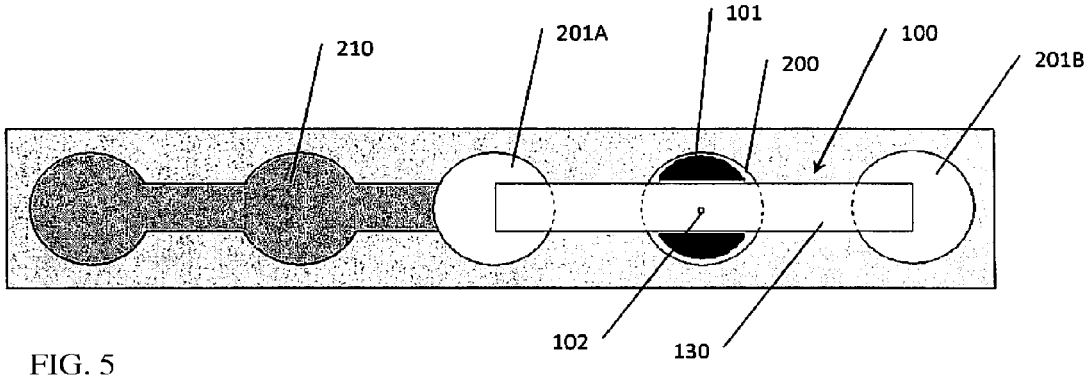
FIG. 5 shows a plan view of the tool while making a second panel that is contiguous to the first one.
Figure 14:
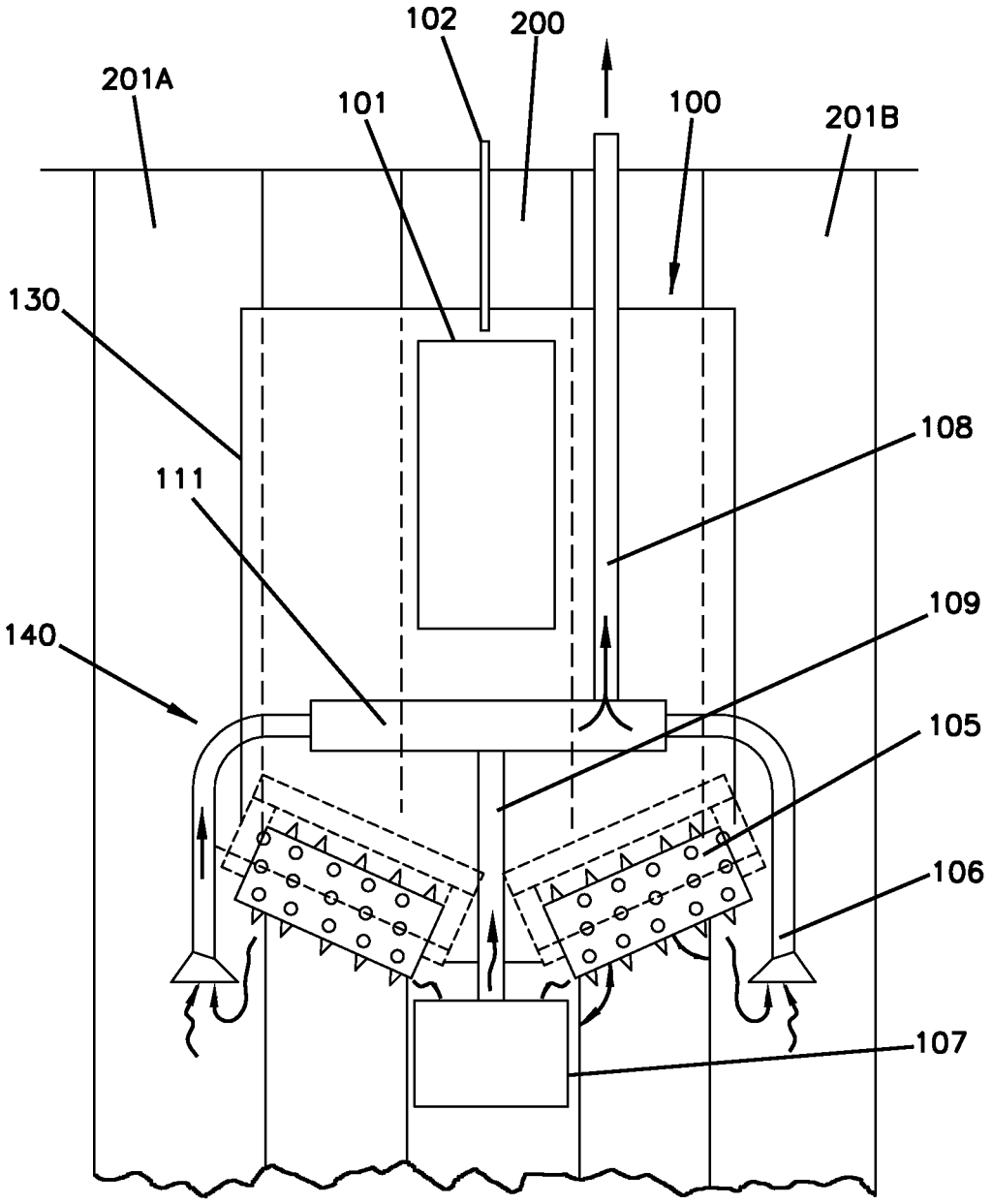
FIGS. 14 and 15 illustrate two different variants of the tool.
Figure 15:
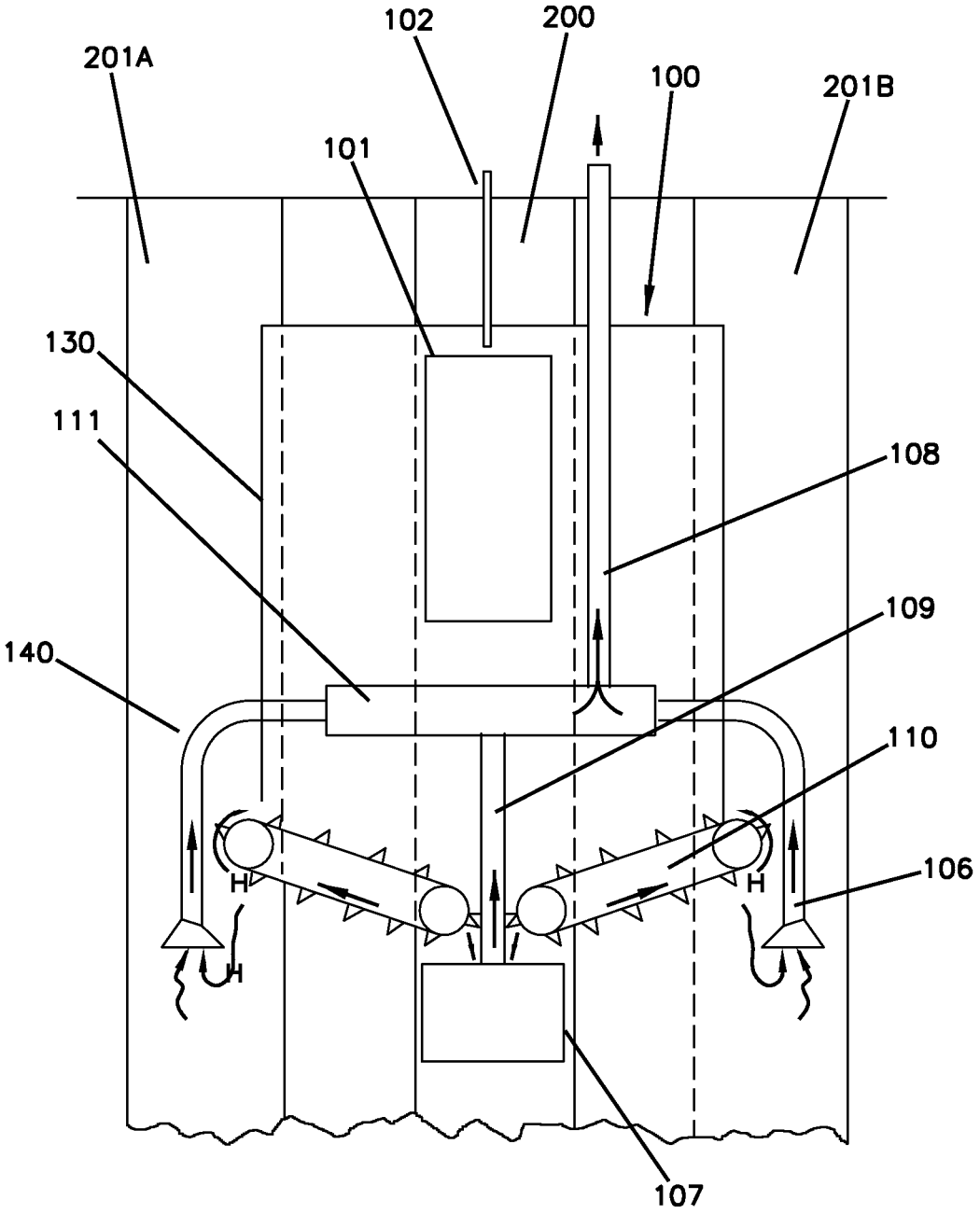

Element 120 represents a lower guide, which may or may not be present, used so as to increase the efficiency of the guide system. FIGS. 3 and 4, which are different embodiments of the same guide 120, element 121 is substantially cross-shaped, element 122, on the other hand, has a circular shape so as to engage with the shape of the hole. The excavation debris falls into holes 200, 201A and 201B although through suitable provisions on the cutting means it would be possible to achieve a selective falling of this debris either in the hole 200 or in at least one of holes 201. This excavation debris is deposited at the bottom of the hole and is recovered by the system for evacuation of debris 140 when, as the tool advances, it starts to hit the debris. The systems for evacuation of debris are known systems and can be made through centrifugal pumps, volumetric pumps or so called "air-lift" systems. A further solution is represented in FIGS. 14 and 15 and is explained in the rest of the description. FIG. 5 represents tool 100 during the making of a second panel continuing on from a first one made. The first panel can be cast completely and consequently it is necessary to re-excavate lateral hole 201A or a tube form can be introduced into lateral hole 201A during the casting so that it does not need to be re-excavated. In this case an extreme verticality of hole 201 A is not necessary since it is not used as a guide. This advantageously makes it possible to use Shape-tubes or structures that in any case leave the hole open without them having to be kept vertically with suitable tools or devices.

Figure 6:
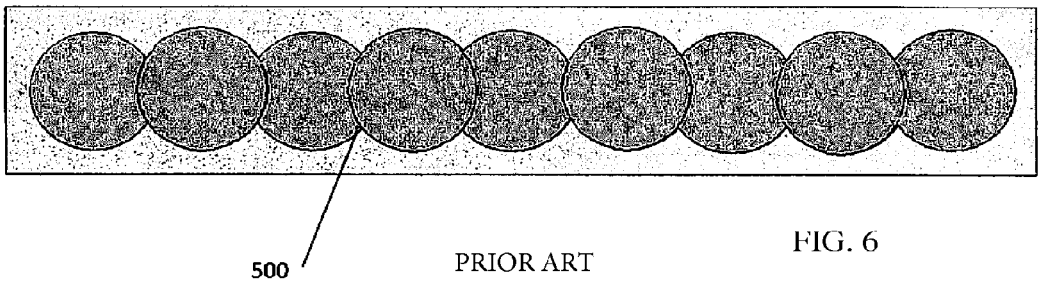
PRIOR ART FIG. 6
FIG. 6 represents a panel made with a classic method so as to compare it with the method according to the present patent application.

FIG. 6 represents the embodiment of a diaphragm wall (or continuous curtain) through a classic method with intersecting piles. The already known methods for making piles make it possible to make them also in high resistance ground, but as it should be clear, in order to ensure the alignment and continuity of the panel to be made it is necessary to use a small distance between centres and thus make a high number of piles so as to compensate for possible deviations and consequently obtain a high number of joints 500 which can represent areas of discontinuity. It should also be clear that there is a greater consumption of concrete or of filling materials.

Figure 7:
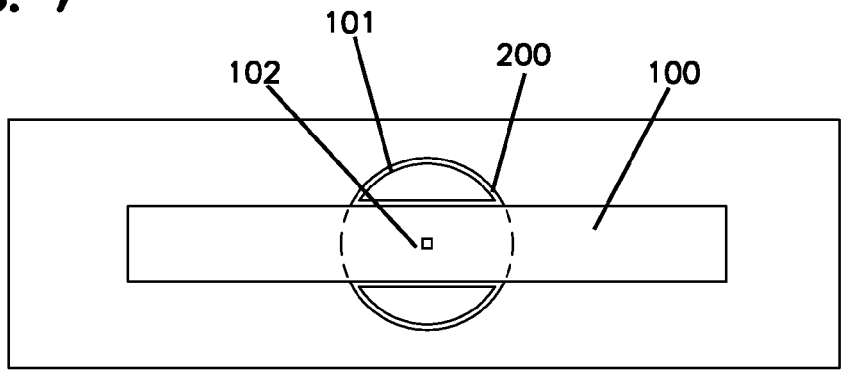
FIGS. 7 and 8 illustrate an alternative method which foresees the use of a single central guide hole.
Figure 8:
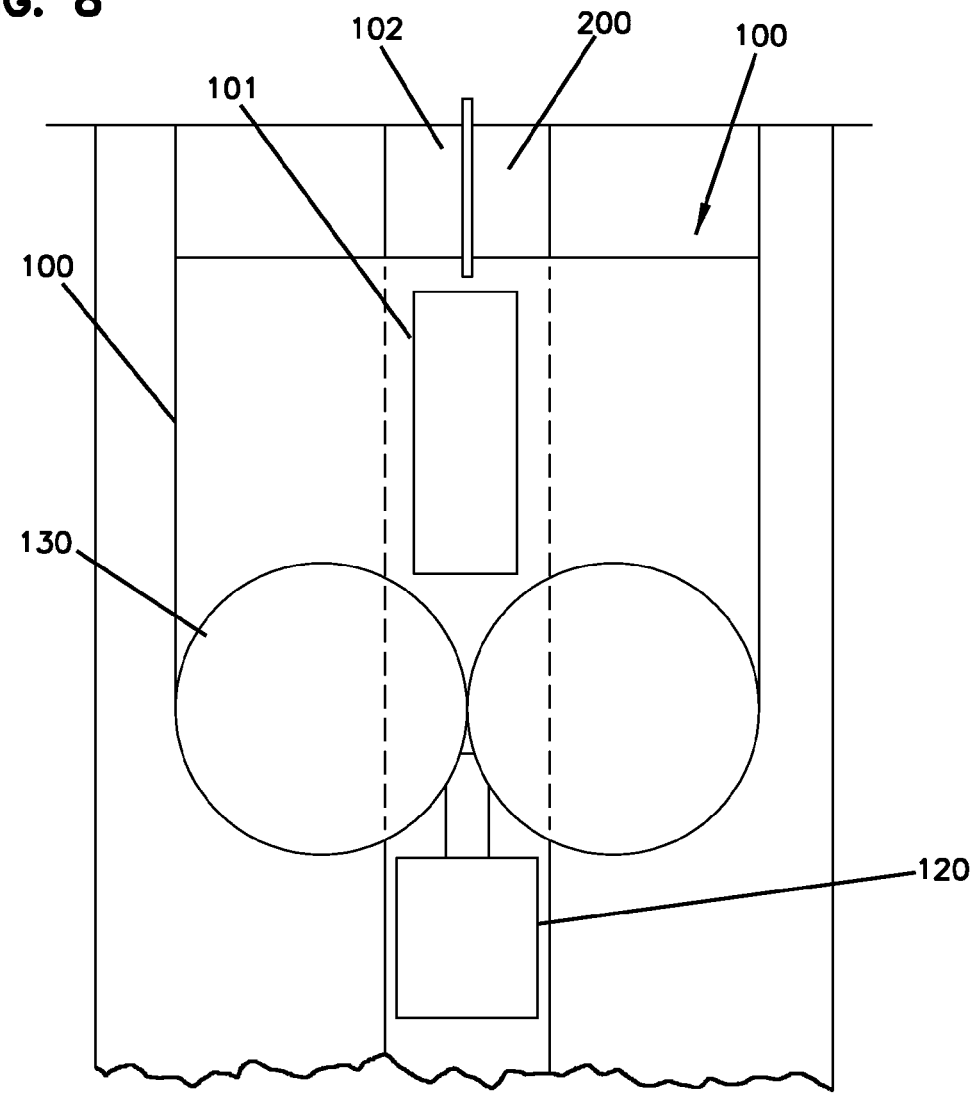

With reference to FIGS. 7 and 8, one variant of the method foresees making only the guide hole at the centre of the panel. In this case the control of the rotation around the longitudinal axis of the hole could be made by using, as suspension elements 102, shafts or Kelly rods that are capable of transmitting the advancing and returning forces and the necessary rotation adjustment torques.

Figure 9:
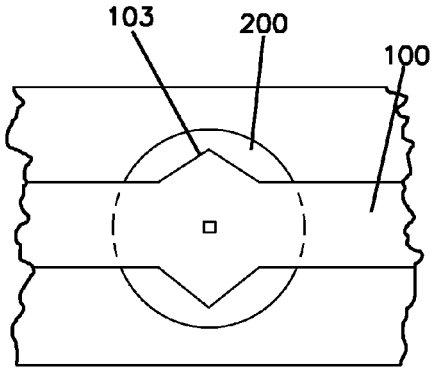
FIG. 9 shows a different embodiment of the guide system.
Figure 10:
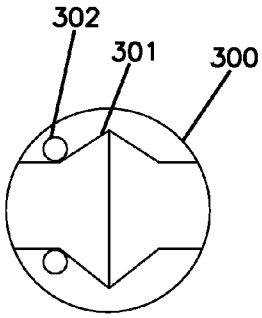
FIG. 10 illustrates the relative shape-tube of the element of FIG. 9.
Figure 11:
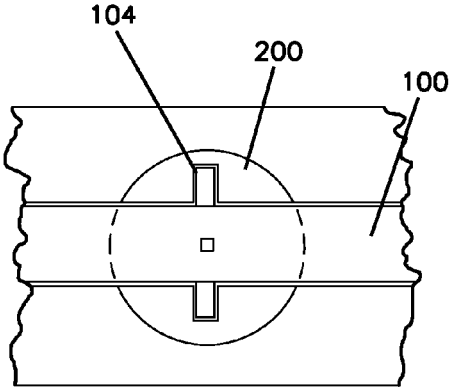
FIG. 11 illustrates a further different embodiment of the guide system
Figure 12:
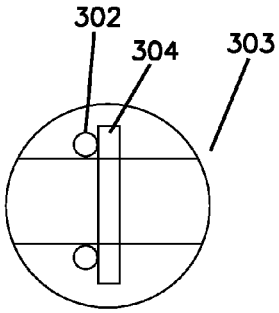
FIG. 12 represents the relative shape-tube of the further embodiment of FIG. 11.

FIG. 9 represents a different solution for guiding the tool which foresees partially filling hole 200 with concrete or hardening materials, through the use of a shape-tube 300. Guide 103 is of a prismatic shape so as to prevent rotations of the tool about the axis of excavation. Guides 103 can be fixedly attached to the frame of the tool through actuators so as to recover possible clearances or to carry out corrections on the deviation. Shape-tube 300 has geometry 301 which is intended to be exploited to guide the tool and suitable pipings 302 so as to cast the volumes which are desired to be filled. In this case the depths of the panel cannot be excessively high since it is necessary to keep the tube forms aligned for their entire length. FIG. 11 shows another type of prismatic shaped guide that is adapted for preventing rotations of the tool and possibly carrying out corrections. FIG. 12 shows the relative shape-tube.

Figure 13:
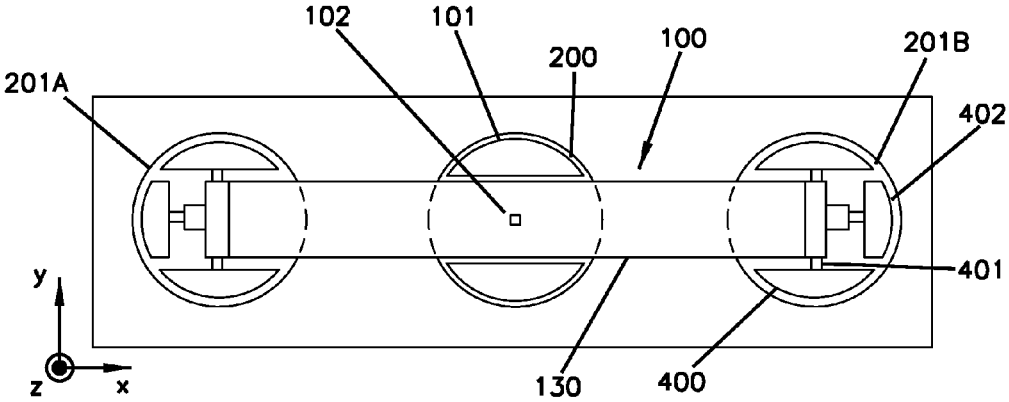
FIG. 13 illustrates a plan view of the tool with an implemented system for correcting deviations.

FIG. 13 is a variant of the tool representing systems 400 for the correction of the deviations in x, y and z (the latter axis represented coming out from the sheet and coinciding with the direction of the excavation axis). This is possible by suitably using the shields of type 400 oriented in direction y and the shields of type 402 oriented in direction x. Shields 400 and 402 can also be made in the form of a simple roller or buffer and act against the walls of the two lateral holes so as to limit the rotation movement of tool 100, between the two positioning ends defined by the size of holes 201A and 201B. Alternatively, each shield could be moved by its own actuator 401 so as to act in contrast with the walls of the holes and actively control the position of tool 100.

An alternative milling system to that indicated in FIGS. 2, 8, is that represented in FIG. 14 in which there are two or more milling drums 105 with their axis preferably inclined with respect to the horizontal and with a direction that coincides with the longitudinal plane of the panel. The inclination of the drums as represented in the figures, implies that the angle indicated in the figure as $\alpha 1$ is greater than $\alpha 2$. This leads to a greater difficulty in breaking the cusps in area al and therefore less material falls in guide hole 200. Moreover, this inclination makes the tool self-centering (the lateral cutting forces are balanced by using two opposite cutting systems) and therefore less subject to deviations. In this variant it is possible to orient the rotation direction of the milling elements so as to facilitate the falling of debris in lateral holes 201A and 201B. Element 107 can be a simple guide and have the same characteristics as those previously described in FIGS. 2, 3 and 4 or have a further second function: if made in the shape of a cup with a closed bottom, it can act as a guide and as a container to collect possible debris which can accidentally fall into the central area. Device 140 represents the debris evacuation system, made up, in a first form, of a collecting element 111 in connection with suction duct 106 that collects debris from lateral holes 201 and possibly also connected to a central suction duct 109 that collects the debris which accumulates in 107 or on central hole 200. If necessary, through a system of taps and valves with a remote control (not represented) contained in collecting element 111, it is possible to carry out a selective suction from a single point so as to increase its efficiency. The collection of debris in element 107 is advantageous since it makes it possible to avoid accumulation of debris at the bottom of guide hole 200 and that could make it impossible to reach the required depth. Element 108 represents a rigid or flexible piping which carries the debris to the surface.

The same collector 111 can contain the pumping element (centrifugal or volumetric pump or other equivalent systems) or, alternatively, it can contain a system of the "air-lift" type. More simply, a variant of this device could be made through an "air-lift" tube which is selectively inserted in the hole from which it is desired to remove the debris and that is kept at a distance from the digging device.

FIG. 15 shows an alternative milling system in which the drums are replaced by two or more cutting means 110 of the chain type with cutting edges.

The systems represented in FIGS. 14 and 15 are possible only by exploiting the method previously illustrated in which the tool is guided on a central hole and in which there are lateral holes. This because in the lateral holes it is possible to house the motors M and the necessary mechanical equipment so as to make cutting means 105 and 110 that would not have enough space in the bulk of the panel.

The execution with the guide on the two lateral holes requires high precision and verticality in making them so as to avoid getting stuck during the execution of the panel. The timing and the methods for making these holes, which are so precise, have a heavy impact on the excavation cycle, drastically reducing the productivity of these methods. On the other hand, by using a single central guide, it is possible for this hole to be made with normal excavation methods or if required with more precise excavation methods, all to the advantage of the installation time. With reference to the first variant of the method (FIGS. 1 and 2), the fact that the lateral holes are not perfectly parallel to one another is not a problem since it is not necessary to be guided along them.

With the tool guided it is possible to increase its weight (through suitable ballast weights) so as to increase its productivity or to make it possible to excavate in harder and more resistant ground. It is known that the addition of weight in these type of tools leads to great deviations if the tool is unbalanced or loses its verticality. It is thus necessary to have a guide system that is reliable and strong like that claimed here, which makes it possible therefore to maintain the direction of the hole carried out without the danger of getting stuck and being able to control the sole rotation about the axis of the hole through the means which have been indicated.

In reference to the first embodiment of the method (FIGS. 1 and 2), the presence of the two lateral holes has two important advantages:

- decreasing the front excavation area and thus considerably increasing productivity when the excavation tool is used and moreover making it possible to be used even in ground with high resistance or making it possible to lengthen the panel;
- ensuring that contiguous panels are placed over one another, i.e. they are aligned;
- substantially reducing the number of joints between contiguous panels, which can represent areas of discontinuity, with respect to a method for making panels through intersecting piles;
- reducing in a considerable manner the consumption of concrete or of the materials for filling the panel itself, with respect to a method for making panels through intersecting piles.

In relation to the variant described in FIGS. 7 and 8, the simplification of the drilling required for the guide and the subsequent execution of the panel is even clearer, all to the advantage of timing and productivity of the method. The insertion of a fixed rod 102 or one that is moveable in rotation makes it possible to orient the excavation tool so as to control its direction and respect the requirements specified in the design concerning alignment tolerances. Moreover this type of active control can be carried out at every excavation depth.

With reference to the embodiment of FIGS. 14 and 15 described previously, in addition to the advantages described there is a greater precision due to the fact that the excavation edge is convex and thus self-centring during the drilling. This implies the possibility of adding further weight so as to increase the production and possibly increase the longitudinal dimension of the panel made.

The same system for evacuating debris 140 described in FIGS. 14 and 15 through elements 106, 107, 108, 109 and 111 can be used even with other excavation tools like those represented in FIGS. 1, 2, 7, 8 and FIG. 13 so as to ensure, in addition to the evacuation of debris, also the cleaning of the guide or correction areas so as to prevent the tool from getting stuck.

The invention claimed is:

1. A method for drilling, and forming a diaphragm wall panel by a cutting tool carried by a frame supported by suspension and movement means, the method comprising the following consecutive steps:

a) forming a single guide hole as far as a depth specified in a design;

b) starting excavating to form one panel, excavating outside the single guide hole, and maintaining the single guide hole at a center point of an excavation to form the panel, and at the same time, introducing a guide element into the single guide hole, said guide element being rigidly fixed with respect to the frame and having a geometry configured for mating with the single guide hole; said guide element guiding the cutting tool along the depth of the guide hole to avoid deviation of the cutting tool;

c) executing the excavation, excavating as far as the depth specified in the design by said cutting tool, said guide element sliding downward along said guide hole during execution of the excavation;

d) extracting the cutting tool from the excavation;

e) filling of the excavation with casting concrete and formation of the panel.

2. The method according to claim 1, further comprising repeating steps a)-e) for making adjacent contiguous panels, and continuing from a first panel.

3. The method according to claim 1, wherein, after step a) of forming the guide hole, the guide hole is partially filled with hardening material so that once the material hardens, the guide hole achieves a prismatic shape adapted to mate with the guide element having a complementary shape to prevent accidental rotation of the cutting tool about an axis of excavation.

4. The method according to claim 1, wherein, subsequently after step a) of forming the guide hole, two further lateral holes are made as far as the depth specified in the design and lateral to the hole already made and at a distance from the hole already made to be located in a position corresponding to a joint between adjacent contiguous panels.

5. The method according to claim 4, wherein sliding within the lateral holes are shield appendages lateral to the frame, acting against walls of the lateral holes to limit and/or correct accidental deviations about axes x, y, and z of the cutting tool during excavation.

6. The method according to claim 1, comprising a debris evacuation phase executed during step c) of excavating.

7. The method according to claim 1, comprising a phase of controlling rotation of the cutting means around an axis of said guide hole.

8. Drilling device for excavating a diaphragm wall panel; the drilling device comprising:

- a frame equipped with at least two cutting tools set alongside one another and symmetrically disposed with respect to a center point of the frame, said cutting means defining extension of a front excavation area of excavation to form a single panel,
- a guide element rigidly fixed and positioned at the center point of the frame between said at least two cutting tools, said guide element being rigidly fixed with respect to the frame; said guide element having a geometry complementary to a central guide hole previously made in the ground for an entire depth specified in a design; said guide element sliding along said central guide hole defining a center point of the front excavation area to form the panel, said guide element guiding the cutting tools along a depth of the hole to avoid deviation of the cutting tool;
- said cutting tools being symmetrically disposed with respect to said guide element.

9. The device according to claim 8, wherein the cutting tools are circular millers.

10. The device according to claim 8, wherein the cutting tools are milling drums with axes inclined with respect to a horizontal plane and with a direction coinciding with a longitudinal plane of the panel.

11. The device according to claim 8, wherein the cutting tools are chains provided with cutting edges, the chains being inclined with respect to a horizontal plane and arranged with the cutting edges working in a plane coinciding with a longitudinal plane of the panel.

12. The device according to claim 8, wherein positioned laterally on the frame are shield appendages, adapted to slide in two further holes made at the sides of the central hole and at a distance from the central hole to be located in a position corresponding to a joint between adjacent panels.

13. The device according to claim 8, wherein the guide element has a geometry configured to collect debris falling into the guide hole, and wherein a system for evacuation of debris has a suction mouth in a position corresponding to a space for collection of debris contained in the guide element.

14. The device according to claim 8, wherein the drilling device is equipped with a system for evacuation of debris adapted to modulate opening of mouths for selective collection of material from two additional guide holes formed at sides of the central hole.

15. The device according to claim 8, wherein the guide element has a prismatic shape adapted to mate with the guide hole having a complementary shape to prevent accidental rotation of the cutting tool about an axis of excavation.

16. The device according to claim 8, comprising an element adapted to control rotation of the cutting means around an axis of the guide hole.

17. A method for drilling and forming a diaphragm wall panel by a cutting tool carried by a frame supported by means for suspending and moving, the method comprising the following steps:

a) forming a single guide hole to a depth specified in a design, the single guide hole defining a center point of an excavation to form one panel;

b) starting excavation outside the single guide hole, and at the same time introducing a guide element into the single guide hole; said guide element being rigidly fixed with respect to the frame and having a geometry configured for mating with the guide hole; said guide element guiding the cutting tool along the depth of the guide hole to avoid deviation of the cutting tool;

c) executing the excavation, excavating to the depth specified in the design by said cutting tool, always maintaining said single guide hole at the center of the excavation; said guide element sliding downward along said guide hole during the executing of the excavation;

d) extracting the cutting tool from the excavation; and e) filling the excavation with casting concrete and forming the panel.

18. A method for drilling and forming a diaphragm wall panel by a cutting tool carried by a frame supported by means for suspending and moving, the method comprising the following steps:

a) forming a single guide hole to a depth specified in a design, the single guide hole defining a center point of an excavation to form one panel;

b) starting excavation outside the single guide hole, along a longitudinal extension of the diaphragm wall, contemporaneously to a left side and to a right side with respect to the guide hole in a symmetric manner, and at the same time introducing a guide element into the single guide hole; said guide element being rigidly fixed with respect to the frame and having a geometry configured for mating with the guide hole; said guide element guiding the cutting tool along the depth of the guide hole in order to avoid deviation of the cutting tool;

c) executing the excavation, excavating to the depth specified in the design, by said cutting tool; said guide element sliding downward along said guide hole during the execution of the excavation;

d) extracting the cutting tool from the excavation; and e) filling the excavation with casting concrete and forming the panel.

19. A method for drilling and forming a diaphragm wall panel by a cutting tool carried by a frame supported by means for suspending and moving, the method comprising the following steps:

a) forming a single circular guide hole as far as a depth specified in a design, the single guide hole defining a center point of an excavation to form one panel, said guide hole is positioned in the ground with directional perforation in order to align verticality;

b) starting excavation outside the single guide hole, and at the same time introducing a guide element into the single guide hole; said guide element being rigidly fixed with respect to the frame and having a geometry configured for mating with the guide hole; said guide element guiding the cutting tool along the depth of the guide hole to avoid deviation of the cutting tool;

c) executing the excavation, excavating to the depth specified in the design by means of said cutting tool; said guide element sliding along said guide hole during the execution of the excavation;

d) extracting the cutting tool from the excavation; and e) filling the excavation with casting concrete and forming the panel.

* * * * *